US009447739B2

(12) United States Patent
Kim et al.

(10) Patent No.: US 9,447,739 B2
(45) Date of Patent: Sep. 20, 2016

(54) VARIABLE COMPRESSION RATIO ENGINE

(71) Applicant: Hyundai Motor Company, Seoul (KR)

(72) Inventors: Won Gyu Kim, Seoul (KR); Eun Ho Lee, Suwon-si (KR); Young Hong Kwak, Suwon-si (KR); Myungsik Choi, Seoul (KR); Yoonsik Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 102 days.

(21) Appl. No.: 14/485,479

(22) Filed: Sep. 12, 2014

(65) Prior Publication Data

US 2015/0167563 A1 Jun. 18, 2015

(30) Foreign Application Priority Data

Dec. 18, 2013 (KR) ..... 10-2013-0158576

(51) Int. Cl.
*F02B 75/04* (2006.01)
*F02D 15/04* (2006.01)

(52) U.S. Cl.
CPC ..... *F02D 15/04* (2013.01)

(58) Field of Classification Search
CPC ..... F02D 15/04
USPC ..... 123/78 AA, 48 A, 48 AA
See application file for complete search history.

(56) References Cited

U.S. PATENT DOCUMENTS 1,167,023 A * 1/1916 Schmidt ..... F02B 75/042 123/66
2,260,982 A * 10/1941 Walker ..... F02D 15/04 123/78 AA
2,420,117 A * 5/1947 Weatherup ..... F02B 1/00 123/48 AA
3,970,056 A * 7/1976 Morris ..... F02D 15/04 123/48 D
4,516,537 A * 5/1985 Nakahara ..... F02D 15/04 123/48 AA
5,195,469 A 3/1993 Syed
7,588,000 B2 * 9/2009 Crower ..... F02B 75/042 123/48 AA
2003/0097998 A1 * 5/2003 Gray, Jr. ..... F02B 1/12 123/48 AA
2003/0192490 A1 * 10/2003 Maloney ..... F02B 75/042 123/48 A

FOREIGN PATENT DOCUMENTS

JP 59-63340 A 4/1984
JP 11-50866 A 2/1999
JP 2008-128227 A 6/2008

(Continued)

*Primary Examiner* — Marguerite McMahon
(74) *Attorney, Agent, or Firm* — Morgan, Lewis & Bockius LLP

(57) ABSTRACT

A variable compression ratio engine includes a variable chamber housing in fluidic communication with a combustion chamber of the engine, a chamber plunger slidably disposed within the variable chamber housing and forming a variable chamber together with the variable chamber housing, a hydraulic pressure cylinder connected with the variable chamber housing, a hydraulic piston slidably disposed within the hydraulic pressure cylinder, having a slider protruded to form first and second operation chambers with the hydraulic pressure cylinder and connected with the chamber plunger, a control plunger connected with the hydraulic piston, a control cylinder for receiving the control plunger and slidable with respect to the control plunger, a compression ratio control portion selectively moving the control cylinder along the length direction, and hydraulic pressure lines supplying control hydraulic pressure to the first or second operation chamber or releasing the control hydraulic pressure from the first or second operation chamber according to relative positions of the control cylinder.

19 Claims, 9 Drawing Sheets

(56) References Cited

FOREIGN PATENT DOCUMENTS

| | | | |
|---|---|---|---|
| JP | 2009-36128 | A | 2/2009 |
| JP | 2009-36188 | A | 2/2009 |
| KR | 0130587 | B1 | 4/1998 |
| KR | 1998-047819 | U | 9/1998 |
| KR | 1998-050235 | A | 9/1998 |
| KR | 10-2012-0010881 | A | 2/2012 |
| KR | 10-1382318 | B1 | 4/2014 |
| WO | WO 97/11264 | A1 | 3/1997 |

* cited by examiner

VARIABLE COMPRESSION RATIO ENGINE

CROSS-REFERENCE TO RELATED APPLICATION

The present application claims priority of Korean Patent Application Number 10-2013-0158576 filed on Dec. 18, 2013, the entire contents of which application are incorporated herein for all purposes by this reference.

BACKGROUND OF INVENTION

1. Field of Invention

The present invention relates to a variable compress ratio engine. More particularly, the present invention relates to a variable compress ratio engine, which may absorb combustion impact and may improve durability.

2. Description of Related Art

In general, the compression ratio of an internal combustion engine is represented by the largest volume of a combustion chamber prior to compression and the smallest volume of the combustion chamber after compression in a compression stroke of the internal combustion engine.

The output of the internal combustion engine increases as the compression ratio of the internal combustion engine is increased. However, if the compression ratio of the internal combustion engine is too high, so-called knocking occurs, and this even decreases the output of the internal combustion engine and also results in overheating of the internal combustion engine, a failure in a valve or piston of the internal combustion engine, and so on.

Accordingly, the compression ratio of the internal combustion engine is set to a specific value within an appropriate range prior to the occurrence of knocking. As such, because the air-fuel ratio and output of the internal combustion engine can be improved by properly varying the compression ratio according to the load of the internal combustion engine, various approaches are being proposed to vary the compression ratio of the internal combustion engine.

These approaches for varying the compression ratio of the internal combustion engine mostly employ methods that vary the volume of the compression chamber during a compression stroke. For example, there have been proposed methods that vary the height of the top dead center of a piston during a compression stroke, or increase or decrease the volume of a sub-compression chamber provided in a cylinder head.

Varying the height of the top dead center of a piston tends to make the structure of the internal combustion engine complicated. Therefore, it will be desirable to vary the compression ratio by providing a sub-compression chamber in a cylinder head to make the structure simple and achieve great improvement in air-fuel ratio.

However, since combustion impact in combustion stroke is directly transmitted to elements of a variable compress ratio device so that durability of the elements may be deteriorated.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide a variable compress ratio engine having advantages of improving durability, reducing power for operating a device, and enhancing responsibility by providing a hydraulic pressure chamber for absorbing combustion impact.

A variable compression ratio engine according to various aspects of the present invention may include a variable chamber housing in fluidic communication with a combustion chamber of the engine, a chamber plunger slidably disposed within the variable chamber housing and forming a variable chamber together with the variable chamber housing, a hydraulic pressure cylinder connected with the variable chamber housing, a hydraulic piston, which is slidably disposed within the hydraulic pressure cylinder, of which a slider is protruded to form a first and a second operation chambers together with the hydraulic pressure cylinder, and which is connected with the chamber plunger, a control plunger connected with the hydraulic piston, a control cylinder of which the control plunger is disposed therein, and the control cylinder relatively slidable with respect to the control plunger, a compression ratio control portion selectively moving the control cylinder along a length direction thereof, and hydraulic pressure lines supplying control hydraulic pressure to the first operation chamber or the second operation chamber or releasing the control hydraulic pressure from the first operation chamber or the second operation chamber according to relative positions of the control cylinder.

The control cylinder may be formed with a supply port receiving the control hydraulic pressure, a first exhaust port and a second exhaust port for releasing the control hydraulic pressure, a first control port in fluidic communication with the first operation chamber; and a second control port in fluidic communication with the second operation chamber. The control plunger may be formed with a first and a second lands. And the first and the second lands may be capable of selectively closing the first and second control ports respectively, the supply port and the first control port may be in fluidic communication and the second control port and the second exhaust port may be in fluidic communication, or the supply port and the second control port may be in fluidic communication and the first control port and the first exhaust port may be in fluidic communication according to relative positions of the control plunger and the control cylinder.

When the control cylinder moves toward the hydraulic piston according to an operation of the compression ratio control portion, the supply port and the first control port may be in fluidic communication so as to supply the control hydraulic pressure to the first operation chamber, and the second control port and the second exhaust port may be in fluidic communication so as to release the control hydraulic pressure of the second operation chamber through the second exhaust port. When the control cylinder moves away from the hydraulic piston according to an operation of the compression ratio control portion, the supply port and the second control port may be in fluidic communication so as to supply the control hydraulic pressure to the second operation chamber, and the first control port and the first exhaust port may be in fluidic communication so as to release the control hydraulic pressure of the first operation chamber through the first exhaust port.

The compression ratio control portion may include a control shaft, an eccentric cam connected with the control shaft, and a connecting link connected with the control cylinder and rotatably connected with the eccentric cam, the connecting link varying the relative positions of the control cylinder selectively according to rotation of the control shaft.

The compression ratio control portion may include a crank control shaft connected with the control cylinder for varying the relative positions of the control cylinder by rotation of the crank control shaft. The compression ratio control portion may include a control cylinder spring biasing the control cylinder and a control cam selectively pushing the control cylinder.

The control cylinder is formed with a supply port receiving the control hydraulic pressure, a first control port in fluidic communication with the first operation chamber, a second control port in fluidic communication with the second operation chamber, and a neutral port. The hydraulic pressure lines may include a first hydraulic pressure line connecting the first operation chamber with the first control port, a second hydraulic pressure line connecting the second operation chamber with the second control port and a third hydraulic pressure line connecting the neutral port with the first hydraulic pressure line or connecting the neutral port with the second hydraulic pressure line. The control plunger may be formed with a first and a second lands. The first and the second lands may be capable of selectively closing the first and second control ports respectively, the supply port, the neutral port and the first control port may be in fluidic communication, or the supply port, the neutral port and the second control port may be in fluidic communication according to relative positions of the control plunger and the control cylinder.

The engine may further include a first check valve interposed between the third hydraulic pressure line and the first hydraulic pressure line and a second check valve interposed between the third hydraulic pressure line and the second hydraulic pressure line. The hydraulic pressure may be supplied from the neutral port to the first hydraulic pressure line, or the hydraulic pressure may be supplied from the neutral port to the second hydraulic pressure line.

When the control cylinder moves toward the hydraulic piston according to an operation of the compression ratio control portion, the supply port and the neutral port may be in fluidic communication so as to supply the control hydraulic pressure of the neutral port to the first operation chamber, and to release the control hydraulic pressure of the second operation chamber through the second control port. When the control cylinder moves away from the hydraulic piston according to an operation of the compression ratio control portion, the supply port and the second control port may be in fluidic communication so as to supply the control hydraulic pressure of the neutral port to the second operation chamber, and to release the control hydraulic pressure of the first operation chamber through the first control port.

The engine may further include a hydraulic pressure cylinder spring disposed within the hydraulic pressure cylinder biasing the hydraulic piston toward the combustion chamber. The first and the second check valves may be opened or closed depending on an elastic coefficient of the hydraulic pressure cylinder spring, and a pressure of the combustion chamber.

When the control cylinder moves toward the hydraulic piston according to an operation of the compression ratio control portion and the first check valve is opened, the control hydraulic pressure of the neutral port may be supplied to the first operation chamber, and the control hydraulic pressure of the second operation chamber may be released through the second control port. When the control cylinder moves away from the hydraulic piston according to an operation of the compression ratio control portion and the second check valve is opened, the control hydraulic pressure of the neutral port may be supplied to the second operation chamber and the control hydraulic pressure of the first operation chamber may be released through the first control port.

A variable compression ratio engine according to various other aspects of the present invention may include a variable chamber housing in fluidic communication with a combustion chamber of the engine, a chamber plunger slidably disposed within the variable chamber housing and forming a variable chamber together with the variable chamber housing, a hydraulic pressure cylinder connected with the variable chamber housing, a hydraulic piston, which is slidably disposed within the hydraulic pressure cylinder, of which a slider is protruded to form a first and a second operation chambers together with the hydraulic pressure cylinder, and which is connected with the chamber plunger, a control plunger connected with the hydraulic piston, and of which a first and a second lands are formed thereto, a control cylinder of which the control plunger is disposed therein, and the control cylinder relatively slidable with respect to the control plunger and formed with a supply port receiving the control hydraulic pressure, a first exhaust port and a second exhaust port for releasing the control hydraulic pressure, a first control port in fluidic communication with the first operation chamber, and a second control port in fluidic communication with the second operation chamber, a compression ratio control portion selectively moving the control cylinder along a length direction thereof, and hydraulic pressure lines supplying control hydraulic pressure to the first operation chamber or the second operation chamber or releasing the control hydraulic pressure from the first operation chamber or the second operation chamber according to relative positions of the control cylinder. The first and the second lands may be capable of selectively closing the first and second control ports respectively, the supply port and the first control port may be in fluidic communication and the second control port and the second exhaust port are in fluidic communication, or the supply port and the second control port may be in fluidic communication and the first control port and the first exhaust port may be in fluidic communication according to relative positions of the control plunger and the control cylinder.

When the control cylinder moves toward the hydraulic piston according to an operation of the compression ratio control portion, the supply port and the neutral port may be in fluidic communication so as to supply the control hydraulic pressure of the neutral port to the first operation chamber, and to release the control hydraulic pressure of the second operation chamber through the second control port, and when the control cylinder moves away from the hydraulic piston according to the operation of the compression ratio control portion, the supply port and the second control port may be in fluidic communication so as to supply the control hydraulic pressure of the neutral port to the second operation chamber, and to release the control hydraulic pressure of the first operation chamber through the first control port.

A variable compression ratio engine according to yet various other aspects of the present invention may include a variable chamber housing in fluidic communication with a combustion chamber of the engine, a chamber plunger slidably disposed within the variable chamber housing and forming a variable chamber together with the variable chamber housing, a hydraulic pressure cylinder connected with the variable chamber housing and provided with a hydraulic pressure cylinder spring, a hydraulic piston, which is slidably disposed within the hydraulic pressure cylinder, of which a slider is protruded to form a first and a second operation chambers together with the hydraulic pressure cylinder, which is connected with the chamber plunger, and the hydraulic piston elastically supported toward the combustion chamber by the hydraulic pressure cylinder spring, a control plunger connected with the hydraulic piston, and formed with a first and a second lands, a control cylinder of which the control plunger is disposed therein, and the control cylinder relatively slidable with respect to the control plunger, and formed with a supply port receiving the control hydraulic pressure, a first control port in fluidic communication with the second operation chamber, a second control port in fluidic communication with the first operation chamber, and a neutral port, a compression ratio control portion selectively moving the control cylinder along a length direction thereof, hydraulic pressure lines comprising a first hydraulic pressure line connecting the first operation chamber with the first control port, a second hydraulic pressure line connecting the second operation chamber with the second control port, and a third hydraulic pressure line connecting the neutral port with the first hydraulic pressure line or connecting the neutral port with the second hydraulic pressure line, a first check valve interposed between the third hydraulic pressure line and the first hydraulic pressure line, and a second check valve interposed between the third hydraulic pressure line and the second hydraulic pressure line. The first and the second lands may be capable of selectively closing the first and the second control ports respectively, the supply port, the neutral port and the first control port may be in fluidic communication, or the supply port, the neutral port and the second control port may be in fluidic communication according to relative positions of the control plunger and the control cylinder.

When the control cylinder moves toward the hydraulic piston according to an operation of the compression ratio control portion and the first check valve is opened, the control hydraulic pressure of the neutral port may be supplied to the first operation chamber, and the control hydraulic pressure of the second operation chamber may be released through the second control port, and when the control cylinder moves away from the hydraulic piston according to the operation of the compression ratio control portion and the second check valve is opened, the control hydraulic pressure of the neutral port may be supplied to the second operation chamber and the control hydraulic pressure of the first operation chamber may be released through the first control port.

According to the present invention, durability may be improved, power for operating a device may be reduced, and responsibility may be enhanced by providing a hydraulic pressure chamber for absorbing combustion impact.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
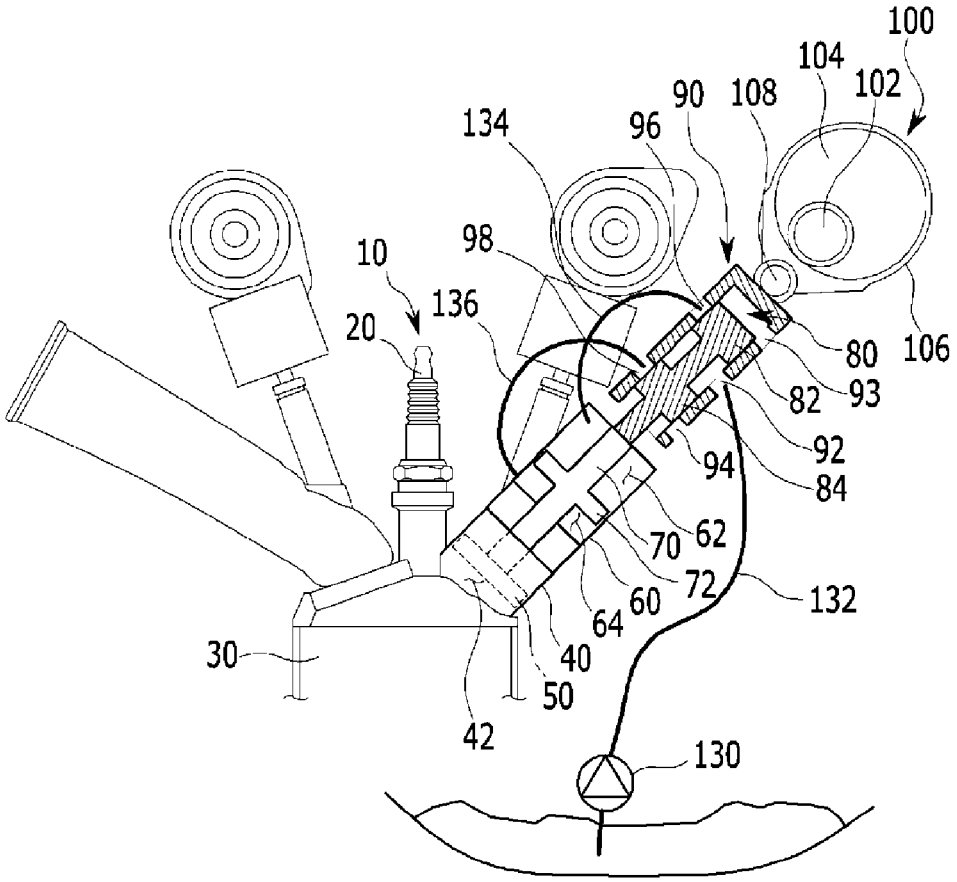
FIG. 1 is a cross-sectional view of an exemplary variable compression ratio engine according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A part irrelevant to the description will be omitted to clearly describe the present invention, and the same or similar elements will be designated by the same reference numerals throughout the specification. In the drawings, the thickness of layers, films, panels, regions, etc., are exaggerated for clarity.

It will be understood that when an element such as a layer, film, region, or substrate is referred to as being "on" another element, it can be directly on the other element or intervening elements may also be present. In contrast, when an element is referred to as being "directly on" another element, there are no intervening elements present. Throughout the specification and the claims, unless explicitly described to the contrary, the word "comprise" and variations such as "comprises" or "comprising", will be understood to imply the inclusion of stated elements but not the exclusion of any other elements.

Figure 2:
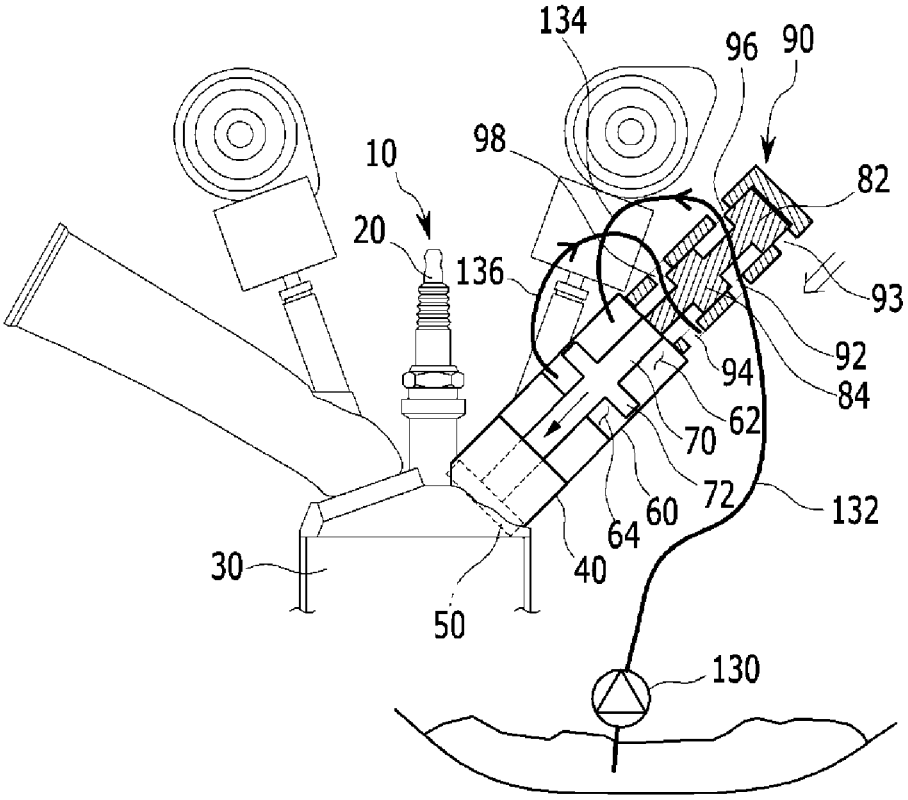
FIG. 2 and FIG. 3 are drawings showing operations of a variable compression ratio engine of FIG. 1.
Figure 3:
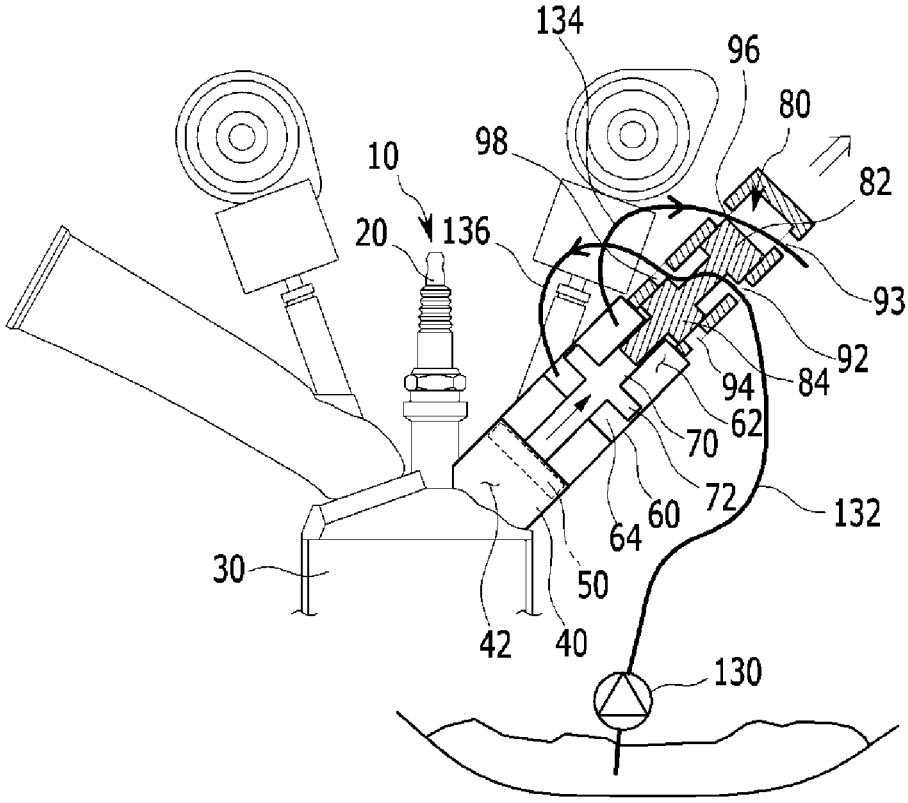
Figure 4:
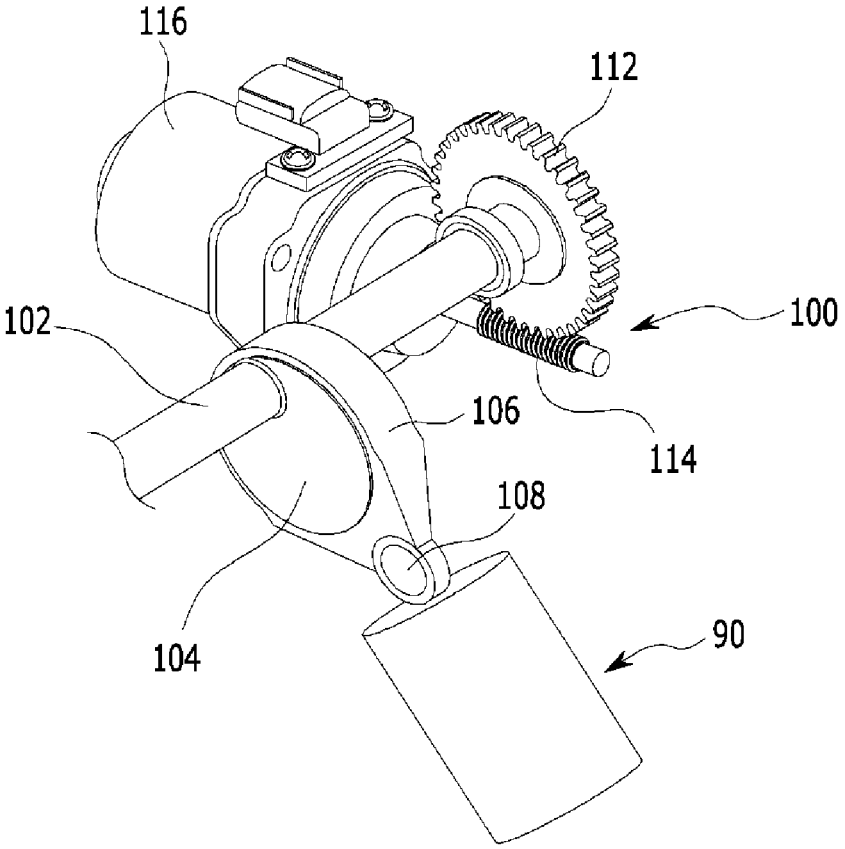
FIG. 4 is a drawing showing an exemplary compression ratio control portion applied to a variable compression ratio engine according to the present invention.

FIG. 1 is a cross-sectional view of a variable compression ratio engine according to the first exemplary embodiment of the present invention, and FIG. 2 and FIG. 3 are drawings showing operations of a variable compression ratio engine according to the first exemplary embodiment of the present invention. FIG. 4 is a drawing showing an exemplary compression ratio control portion applied to a variable compression ratio engine according to various embodiments of the present invention.

Referring to FIG. 1 to FIG. 4, a variable compression ratio engine according to the first exemplary embodiment of the present invention will be described. The variable compression ratio engine 10 according to the first exemplary embodiment of the present invention may be provided with an ignition plug 20 mounted to a cylinder head.

The variable compression ratio engine 10 according to the first exemplary embodiment of the present invention includes a variable chamber housing 40 in fluidic communication with a combustion chamber 30 of the engine, a chamber plunger 50 slidably disposed within the variable chamber housing 40 and forming a variable chamber 42 together with the variable chamber housing 40, a hydraulic pressure cylinder 60 connected with the variable chamber housing 40, a hydraulic piston 70, which is slidably disposed within the hydraulic pressure cylinder 60, of which a slider 72 is protruded to form a first and a second operation chambers 62 and 64 together with the hydraulic pressure cylinder 60, and which is connected with the chamber plunger 50, a control plunger 80 connected with the hydraulic piston 70, a control cylinder 90 of which the control plunger 80 is disposed therein, and the control cylinder 90 relatively slidable with respect to the control plunger 80, a compression ratio control portion 100 selectively moving the control cylinder 90 along the length direction thereof, and hydraulic pressure lines supplying control hydraulic pressure to the first operation chamber 62 or the second operation chamber 64 or releasing the control hydraulic pressure from the first operation chamber 62 or the second operation chamber 64 according to relative positions of the control cylinder 90.

A supply port 92 receiving the control hydraulic pressure, a first exhaust port 93 and a second exhaust port 94 for releasing the control hydraulic pressure, a first control port 96 in fluidic communication with the first operation chamber 62, and a second control port 98 in fluidic communication with the second operation chamber 64 are formed to the control cylinder 90.

A first and a second lands 82 and 84 are formed to the control plunger 80. And the first and the second lands 82 and 84 close the first and second control ports 96 and 98 respectively, the supply port 92 and the first control port 96 are in fluidic communication and the second control port 98 and the second exhaust port 94 are in fluidic communication, or the supply port 92 and the second control port 98 are in fluidic communication and the first control port 96 and the first exhaust port 93 are in fluidic communication according to relative positions of the control plunger 80 and the control cylinder 90.

When a hydraulic pump 130 supplies oil through an oil supply line 132, hydraulic pressure is supplied to the control cylinder 90 through the supply port 92, the first control port 96 and the first operation chamber 62 are in fluidic communication through a first oil line 134, and the second control port 98 and the second operation chamber 64 are in fluidic communication through a second oil line 136.

As shown in FIG. 1, according to relative positions of the control plunger 80 and the control cylinder 90, the first and the second lands 82 and 84 may close the first and the second control ports 96 and 98 respectively. In this state, the hydraulic pressure may not be supplied to the first and the second operation chambers 62 and 64 or the hydraulic pressure may not be released from the first and the second operation chambers 62 and 64, and the position of the chamber plunger 50 is fixed.

As shown in FIG. 2, when the control cylinder 90 moves toward the hydraulic piston 70 direction according to the operation of the compression ratio control portion 100, the supply port 92 and the first control port 96 are in fluidic communication so as to supply the control hydraulic pressure to the first operation chamber 62, and the second control port 98 and the second exhaust port 94 are in fluidic communication so as to release the control hydraulic pressure of the second operation chamber 64 through the second exhaust port 94.

When the control hydraulic pressure is supplied to the first operation chamber 62 and the control hydraulic pressure of the second operation chamber 64 is released, the hydraulic piston 70 moves toward the combustion chamber 30, the chamber plunger 50 connected with the hydraulic piston 70 also moves toward the combustion chamber 30 direction so that compression ratio is increased and fuel consumption may be enhanced.

The hydraulic piston 70 moves toward the combustion chamber 30 direction and then the control plunger 80 also moves toward the combustion chamber 30 direction. So the first and the second lands 82 and 84 may close the first and the second control ports 96 and 98 respectively. In this state, the hydraulic pressure may not be supplied to the first and the second operation chambers 62 and 64 or the hydraulic pressure may not be released from the first and the second operation chambers 62 and 64, and the position of the chamber plunger 50 is fixed.

As shown in FIG. 3, when the control cylinder 90 moves away from the hydraulic piston 70 according to the operation of the compression ratio control portion 100, the supply port 92 and the second control port 98 are in fluidic communication so as to supply the control hydraulic pressure to the second operation chamber 64, and the first control port 96 and the first exhaust port 93 are in fluidic communication so as to release the control hydraulic pressure of the first operation chamber 62 through the first exhaust port 93.

When the control hydraulic pressure is released from the first operation chamber 62 and the control hydraulic pressure is supplied to the second operation chamber 64, the hydraulic piston 70 moves away from the combustion chamber 30, the chamber plunger 50 connected with the hydraulic piston 70 also moves away from the combustion chamber 30 direction. So that compression ratio is reduced and output torque may be enhanced.

The hydraulic piston 70 moves away from the combustion chamber 30 and then the control plunger 80 also moves away from the combustion chamber 30. So the first and the second lands 82 and 84 may close the first and the second control ports 96 and 98 respectively. In this state, the hydraulic pressure may not be supplied to the first and the second operation chambers 62 and 64 or the hydraulic pressure may not be released from the first and the second operation chambers 62 and 64, and the position of the chamber plunger 50 is fixed.

Hereinafter, referring to FIG. 4, the compression ratio control portion 100 will be described.

The compression ratio control portion 100 according to various embodiments of the present invention includes a control shaft 102, an eccentric cam 104 connected with the control shaft 102, and a connecting link 106 connected with the control cylinder 90, rotatably connected with the eccentric cam 104, and varying relative position of the control cylinder 90 according to selective rotation of the control shaft 102. The connecting link 106 and the control cylinder 90 may be connected through a connecting pin 108.

The control shaft 102 is provided with a worm wheel 112 engaged with a worm 114, and the control shaft 102 may control relative position of the control cylinder 90 according to an operation of a drive motor 116 driving the worm 114.

Figure 5:
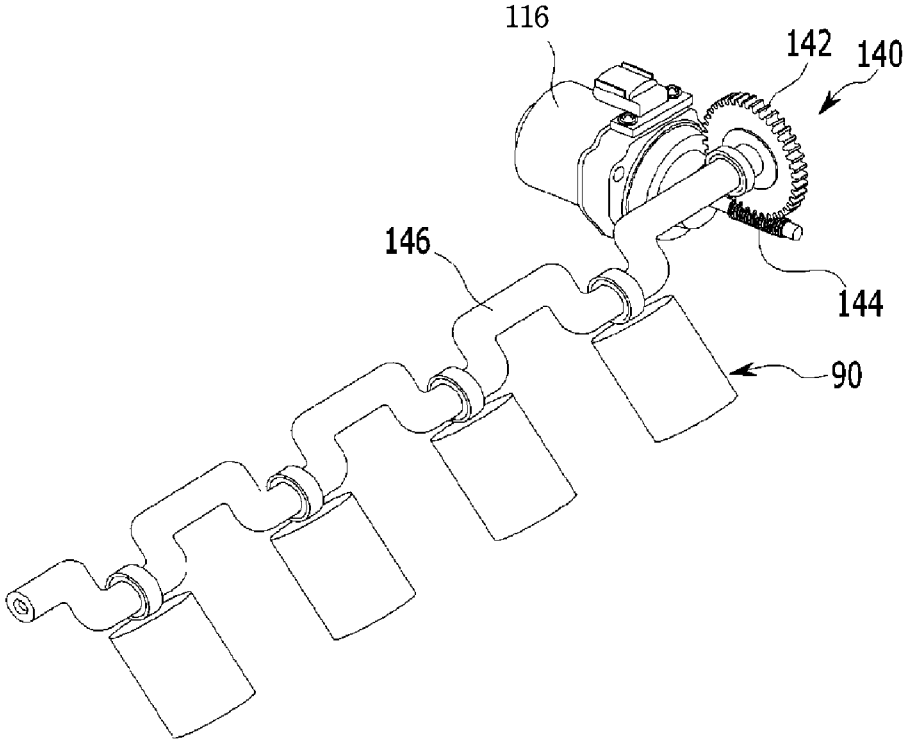
FIGS. 5 and 6 are drawings showing a variant exemplary compression ratio control portion applied to a variable compression ratio engine according to the present invention.

FIG. 5 is a drawing showing one variant exemplary compression ratio control portion applied to a variable compression ratio engine according to the embodiments of the present invention. Referring to FIG. 5, the compression ratio control portion 140 may include a crank control shaft 146 which is connected with the control cylinder 90 and may control position of the control cylinder 90 by selective rotation.

The control shaft 146 is provided with a worm wheel 142 engaged with a worm 144 and the control shaft 146 may control relative position of the control cylinder 90 according to an operation of a drive motor 116 driving the worm 144.

Figure 6:
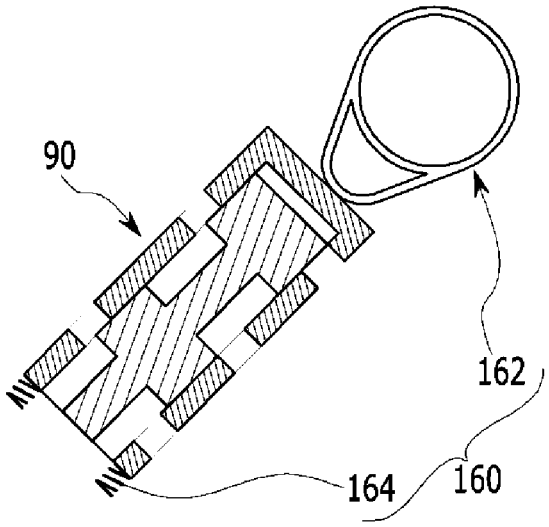

FIG. 6 is a drawing showing another variant exemplary compression ratio control portion applied to a variable compression ratio engine according to various embodiments of the present invention. Referring to FIG. 6, the compression ratio control portion 160 may include a control cylinder spring 164 biasing the control cylinder 90 and a control cam 162 selectively pushing the control cylinder 90. According to rotation of the control cam 162, the relative position of the control cylinder 90 is controlled.

Figure 7:
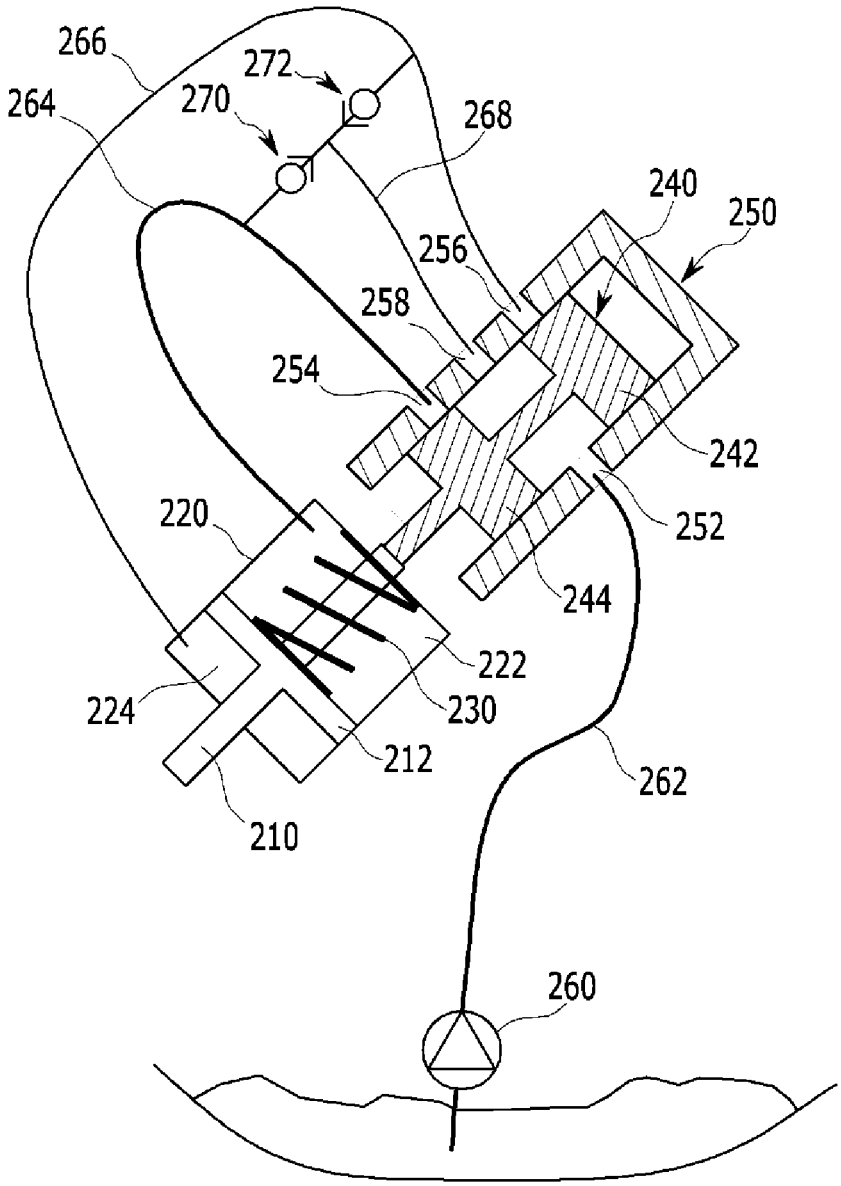
FIG. 7 is a cross-sectional view of another exemplary variable compression ratio engine according to the present invention.
Figure 8:
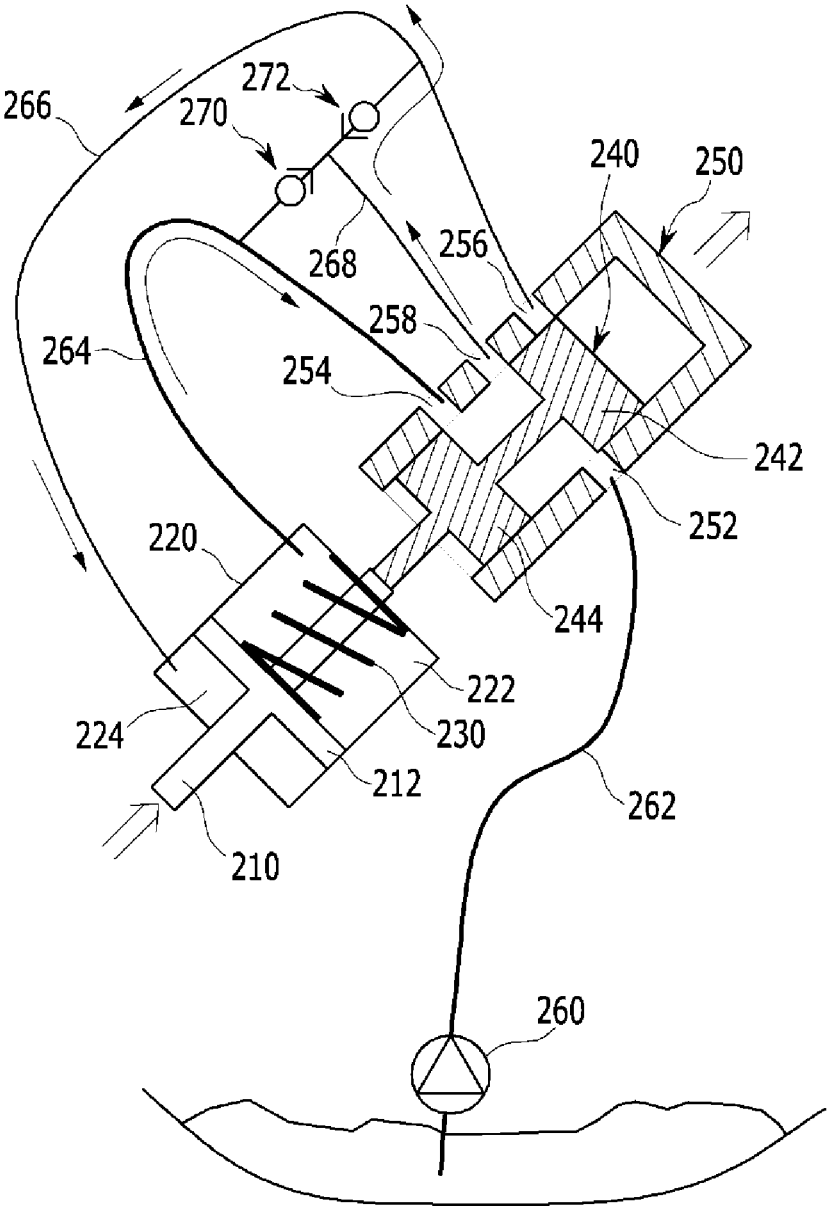
FIG. 8 and FIG. 9 are drawings showing operations of a variable compression ratio engine of FIG. 7.
Figure 9:
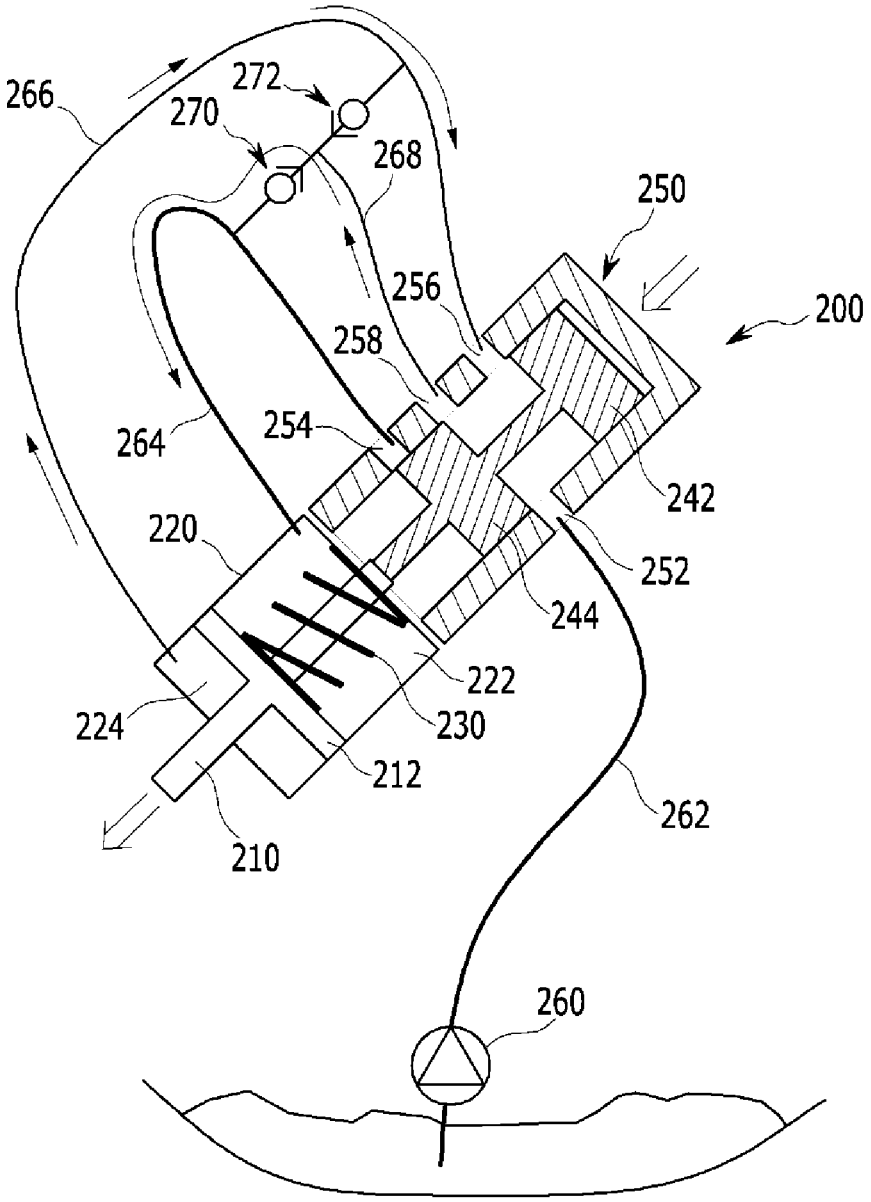

FIG. 7 is a cross-sectional view of a variable compression ratio engine according to the second exemplary embodiment of the present invention, and FIG. 8 and FIG. 9 are drawings showing operations of a variable compression ratio engine according to the second exemplary embodiment of the present invention.

The compression ratio control portion, the chamber plunger and so on of the variable compression ratio engine according to the second exemplary embodiment of the present invention is the same as of the variable compression ratio engine according to the first exemplary embodiment of the present invention previously described. And thus different elements and operation will be described.

The variable chamber housing 40 described above and a hydraulic pressure cylinder 220 is connected, and a hydraulic piston 210 of which a slider 212 is protruded to form a first and a second operation chambers 222 and 224 together with the hydraulic pressure cylinder 220, is slidably disposed within the hydraulic pressure cylinder 220.

The hydraulic piston 210 is connected with a control plunger 240, the control plunger 240 is disposed within a control cylinder 250, and a relative position of the control cylinder 250 is controlled by the operations of the above described the compression ratio control portion 100, 140, or 160.

A supply port 252 receiving the control hydraulic pressure, a first control port 254 in fluidic communication with the first operation chamber 222, a second control port 256 in fluidic communication with the second operation chamber 224 and a neutral port 258 are formed to the control cylinder 250.

A hydraulic pump 260 supplies oil to the supply port 252 through an oil supply line 262, a first hydraulic pressure line 264 connects the first operation chamber 222 with the first control port 254, a second hydraulic pressure line 266 connects the second operation chamber 224 with the second control port 256, and the neutral port 258 and the first hydraulic pressure line 264 or the neutral port 258 and the second hydraulic pressure line 266 are in fluidic communication by a third hydraulic pressure line 268.

A first and a second lands 242 and 244 are formed to the control plunger 240. And the first and the second lands 242 and 244 close the first and second control ports 254 and 256 respectively, or the supply port 252, the neutral port 258 and the first port 254 are in fluidic communication, or the supply port 252, the neutral port 258 and the second port 256 are in fluidic communication.

The engine further includes a first check valve 270 interposed between the third hydraulic pressure line 268 and the first hydraulic pressure line 264, and a second check valve 272 interposed between the third hydraulic pressure line 268 and the second hydraulic pressure line 266. And control the hydraulic pressure is just supplied from the neutral port 258 to the first hydraulic pressure line 264, or the control hydraulic pressure is just supplied from the neutral port 258 to the second hydraulic pressure line 266.

As shown in FIG. 9, the supply port 252 and the neutral port 258 are in fluidic communication, the control hydraulic pressure of the neutral port 258 is supplied to the first operation chamber 222, and the control hydraulic pressure of the second operation chamber 224 is released through the second control port 256 when the control cylinder 250 moves toward the hydraulic piston 210 direction according to the operations of the compression ratio control portion 100, 140, or 160.

As shown in FIG. 8, the supply port 252 and the neutral port 258 are in fluidic communication, the control hydraulic pressure is supplied from the neutral port 258 to the second operation chamber 224, and the control hydraulic pressure of the first operation chamber 222 is released through the first control port 254 when the control cylinder 250 moves away from the hydraulic piston 210 by the operations of the compression ratio control portion 100, 140, or 160.

A hydraulic pressure cylinder spring 230 is disposed within the hydraulic pressure cylinder 220 for elastically supporting the hydraulic piston 210 toward the combustion chamber 30, and the first and the second check valves 20 and 72 are opened and closed according to pressures of set elastic coefficient of the hydraulic pressure cylinder spring 230, and of the combustion chamber.

That is, in the sates that the hydraulic pressure cylinder spring 230 pushes the hydraulic piston 210, if the pressure of the combustion chamber 30 is increased by explosion of fuel, pressure of the first operation chamber 222 is increased so as to supply the oil in the first operation chamber 222 along the arrow direction of FIG. 8.

That is, as shown in FIG. 8, when the control cylinder 250 moves away from the hydraulic piston 210 by the operation of the compression ratio control portion 100, 140, and 16, the second check valve 272 is opened.

In this case, if the pressure of the combustion chamber 30 is higher than the pressure of the set elastic coefficient of the hydraulic pressure cylinder spring 230, for example 5 bar, the pressure of the second operation chamber 224 is less than the pressure of the first operation chamber 222 so as that the oil in the first operation chamber 222 moves along the arrow direction, the hydraulic piston 210 moves upward and compression ratio is reduced. So that, the output torque of the engine is improved.

If the pressure of the combustion chamber 30 is less than the pressure of the set elastic coefficient of the hydraulic pressure cylinder spring 230, for example 5 bar, the second check valve 272 and the second control port 256 are closed so that movement of the hydraulic piston 210 is limited.

When the hydraulic piston 210 moves away from the combustion chamber 30, the control plunger 240 also moves away from the combustion chamber 30, and then the first and the second lands 242 and 244 close the first and the second control ports 254 and 256 respectively. In this state, the control hydraulic pressure may not be supplied to or released from the first and the second operation chambers 222 and 224, and the position of the chamber plunger 50 is fixed.

As shown in FIG. 9, if the control cylinder 250 moves toward the hydraulic piston 210 according to the operation of the compression ratio control portion 100, 140, or 160, the first check valve 270 is opened.

In this case, if the pressure of the combustion chamber 30 is less than the pressure of the set elastic coefficient of the hydraulic pressure cylinder spring 230, for example 5 bar, the pressure of the second operation chamber 224 is higher than the pressure of the first operation chamber 222 so as that the oil in the second operation chamber 224 moves along the arrow direction, the hydraulic piston 210 moves downward and compression ratio is increased. Thus, fuel consumption of the engine may be improved.

If the pressure of the combustion chamber 30 is higher than the pressure of the set elastic coefficient of the hydraulic pressure cylinder spring 230, for example 5 bar, the first check valve 270 and the first control port 254 are closed so that movement of the hydraulic piston 210 is limited.

When the hydraulic piston 210 moves toward the combustion chamber 30, the control plunger 240 also moves toward the combustion chamber 30, and then the first and the second lands 242 and 244 close the first and the second control ports 254 and 256 respectively. In this state, the control hydraulic pressure may not be supplied to or released from the first and the second operation chambers 222 and 224, and the position of the chamber plunger 50 is fixed.

According to the exemplary embodiments of the present invention, durability against the pressure of the combustion chamber may be enhanced by providing the hydraulic pressure chamber to the variable compression ratio engine. Also, power loss for moving the elements may be reduced by providing the control plunger and the control cylinder, and responsiveness may be improved.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio engine comprising:

a variable chamber housing in fluidic communication with a combustion chamber of the engine;

a chamber plunger slidably disposed within the variable chamber housing and forming a variable chamber together with the variable chamber housing;

a hydraulic pressure cylinder connected with the variable chamber housing;

a hydraulic piston, which is slidably disposed within the hydraulic pressure cylinder, of which a slider is protruded to form a first and a second operation chambers together with the hydraulic pressure cylinder, and which is connected with the chamber plunger;

a control plunger connected with the hydraulic piston;

a control cylinder of which the control plunger is disposed therein, and the control cylinder relatively slidable with respect to the control plunger;

a compression ratio control portion selectively moving the control cylinder along a length direction thereof; and hydraulic pressure lines supplying control hydraulic pressure to the first operation chamber or the second operation chamber or releasing the control hydraulic pressure from the first operation chamber or the second operation chamber according to relative positions of the control cylinder.

2. The engine of claim 1, wherein:

the control cylinder is formed with a supply port receiving the control hydraulic pressure, a first exhaust port and a second exhaust port for releasing the control hydraulic pressure, a first control port in fluidic communication with the first operation chamber; and a second control port in fluidic communication with the second operation chamber; and the control plunger is formed with a first and a second lands, wherein the first and the second lands are capable of selectively closing the first and second control ports respectively, and the supply port and the first control port are in fluidic communication and the second control port and the second exhaust port are in fluidic communication, or the supply port and the second control port are in fluidic communication and the first control port and the first exhaust port are in fluidic communication, according to relative positions of the control plunger and the control cylinder.

3. The engine of claim 2, wherein:

when the control cylinder moves toward the hydraulic piston according to an operation of the compression ratio control portion, the supply port and the first control port are in fluidic communication so as to supply the control hydraulic pressure to the first operation chamber, and the second control port and the second exhaust port are in fluidic communication so as to release the control hydraulic pressure of the second operation chamber through the second exhaust port.

4. The engine of claim 2, wherein:

when the control cylinder moves away from the hydraulic piston according to an operation of the compression ratio control portion, the supply port and the second control port are in fluidic communication so as to supply the control hydraulic pressure to the second operation chamber, and the first control port and the first exhaust port are in fluidic communication so as to release the control hydraulic pressure of the first operation chamber through the first exhaust port.

5. The engine of claim 1, wherein the compression ratio control portion comprises:

a control shaft;

an eccentric cam connected with the control shaft; and a connecting link connected with the control cylinder and rotatably connected with the eccentric cam, the connecting link varying the relative positions of the control cylinder selectively according to rotation of the control shaft.

6. The engine of claim 1, wherein the compression ratio control portion comprises a crank control shaft connected with the control cylinder for varying the relative positions of the control cylinder by rotation of the crank control shaft.

7. The engine of claim 1, wherein the compression ratio control portion comprises:

a control cylinder spring biasing the control cylinder; and a control cam selectively pushing the control cylinder.

8. The engine of claim 1, wherein:

the control cylinder is formed with a supply port receiving the control hydraulic pressure, a first control port in fluidic communication with the first operation chamber, a second control port in fluidic communication with the second operation chamber, and a neutral port;

the hydraulic pressure lines comprise:

a first hydraulic pressure line connecting the first operation chamber with the first control port;

a second hydraulic pressure line connecting the second operation chamber with the second control port; and a third hydraulic pressure line connecting the neutral port with the first hydraulic pressure line or connecting the neutral port with the second hydraulic pressure line; and the control plunger is formed with a first and a second lands, wherein the first and the second lands are capable of selectively closing the first and second control ports respectively, and the supply port, the neutral port and the first control port are in fluidic communication, or the supply port, the neutral port and the second control port are in fluidic communication according to relative positions of the control plunger and the control cylinder.

9. The engine of claim 8, further comprises:

a first check valve interposed between the third hydraulic pressure line and the first hydraulic pressure line; and a second check valve interposed between the third hydraulic pressure line and the second hydraulic pressure line, wherein the hydraulic pressure is supplied from the neutral port to the first hydraulic pressure line, or the hydraulic pressure is supplied from the neutral port to the second hydraulic pressure line.

10. The engine of claim 9, wherein:

when the control cylinder moves toward the hydraulic piston according to an operation of the compression ratio control portion, the supply port and the neutral port are in fluidic communication so as to supply the control hydraulic pressure of the neutral port to the first operation chamber, and to release the control hydraulic pressure of the second operation chamber through the second control port.

11. The engine of claim 9, wherein:

when the control cylinder moves away from the hydraulic piston according to an operation of the compression ratio control portion, the supply port and the second control port are in fluidic communication so as to supply the control hydraulic pressure of the neutral port to the second operation chamber, and to release the control hydraulic pressure of the first operation chamber through the first control port.

12. The engine of claim 9, further comprises:

a hydraulic pressure cylinder spring disposed within the hydraulic pressure cylinder biasing the hydraulic piston toward the combustion chamber.

13. The engine of claim 12, wherein the first and the second check valves are opened or closed depending on an elastic coefficient of the hydraulic pressure cylinder spring, and a pressure of the combustion chamber.

14. The engine of claim 13, wherein:

when the control cylinder moves toward the hydraulic piston according to an operation of the compression ratio control portion and the first check valve is opened, the control hydraulic pressure of the neutral port is supplied to the first operation chamber, and the control hydraulic pressure of the second operation chamber is released through the second control port.

15. The engine of claim 13, wherein:

when the control cylinder moves away from the hydraulic piston according to an operation of the compression ratio control portion and the second check valve is opened, the control hydraulic pressure of the neutral port is supplied to the second operation chamber and the control hydraulic pressure of the first operation chamber is released through the first control port.

16. A variable compression ratio engine comprising:

a variable chamber housing in fluidic communication with a combustion chamber of the engine;

a chamber plunger slidably disposed within the variable chamber housing and forming a variable chamber together with the variable chamber housing;

a hydraulic pressure cylinder connected with the variable chamber housing;

a hydraulic piston, which is slidably disposed within the hydraulic pressure cylinder, of which a slider is protruded to form a first and a second operation chambers together with the hydraulic pressure cylinder, and which is connected with the chamber plunger;

a control plunger connected with the hydraulic piston, and of which a first and a second lands are formed thereto;

a control cylinder of which the control plunger is disposed therein, and the control cylinder relatively slidable with respect to the control plunger and formed with a supply port receiving the control hydraulic pressure, a first exhaust port and a second exhaust port for releasing the control hydraulic pressure, a first control port in fluidic communication with the first operation chamber, and a second control port in fluidic communication with the second operation chamber;

a compression ratio control portion selectively moving the control cylinder along a length direction thereof; and hydraulic pressure lines supplying control hydraulic pressure to the first operation chamber or the second operation chamber or releasing the control hydraulic pressure from the first operation chamber or the second operation chamber according to relative positions of the control cylinder, wherein the first and the second lands are capable of selectively closing the first and second control ports respectively, the supply port and the first control port are in fluidic communication and the second control port and the second exhaust port are in fluidic communication, or the supply port and the second control port are in fluidic communication and the first control port and the first exhaust port are in fluidic communication according to relative positions of the control plunger and the control cylinder.

17. The engine of claim 16, wherein:

when the control cylinder moves toward the hydraulic piston according to an operation of the compression ratio control portion, the supply port and the first control port are in fluidic communication so as to supply the control hydraulic pressure to the first operation chamber, and the second control port and the second exhaust port are in fluidic communication so as to release the control hydraulic pressure of the second operation chamber through the second exhaust port; and when the control cylinder moves away from the hydraulic piston according to the operation of the compression ratio control portion, the supply port and the second control port are in fluidic communication so as to supply the control hydraulic pressure to the second operation chamber, and the first control port and the first exhaust port are in fluidic communication so as to release the control hydraulic pressure of the first operation chamber through the first exhaust port.

18. A variable compression ratio engine comprising:

a variable chamber housing in fluidic communication with a combustion chamber of the engine;

a chamber plunger slidably disposed within the variable chamber housing and forming a variable chamber together with the variable chamber housing;

a hydraulic pressure cylinder connected with the variable chamber housing and provided with a hydraulic pressure cylinder spring;

a hydraulic piston, which is slidably disposed within the hydraulic pressure cylinder, of which a slider is protruded to form a first and a second operation chambers together with the hydraulic pressure cylinder, which is connected with the chamber plunger, and the hydraulic piston elastically supported toward the combustion chamber by the hydraulic pressure cylinder spring;

a control plunger connected with the hydraulic piston, and formed with a first and a second lands;

a control cylinder of which the control plunger is disposed therein, and the control cylinder relatively slidable with respect to the control plunger and formed with a supply port receiving the control hydraulic pressure, a first control port in fluidic communication with the second operation chamber, a second control port in fluidic communication with the first operation chamber, and a neutral port;

a compression ratio control portion selectively moving the control cylinder along a length direction thereof;

hydraulic pressure lines comprising a first hydraulic pressure line connecting the first operation chamber with the first control port, a second hydraulic pressure line connecting the second operation chamber with the second control port, and a third hydraulic pressure line connecting the neutral port with the first hydraulic pressure line or connecting the neutral port with the second hydraulic pressure line;

a first check valve interposed between the third hydraulic pressure line and the first hydraulic pressure line; and a second check valve interposed between the third hydraulic pressure line and the second hydraulic pressure line; wherein the first and the second lands are capable of selectively closing the first and the second control ports respectively, the supply port, the neutral port and the first control port are in fluidic communication, or the supply port, the neutral port and the second control port are in fluidic communication according to relative positions of the control plunger and the control cylinder.

19. The engine of claim 18, wherein:

when the control cylinder moves toward the hydraulic piston according to an operation of the compression ratio control portion and the first check valve is opened, the control hydraulic pressure of the neutral port is supplied to the first operation chamber, and the control hydraulic pressure of the second operation chamber is released through the second control port; and when the control cylinder moves away from the hydraulic piston according to the operation of the compression ratio control portion and the second check valve is opened, the control hydraulic pressure of the neutral port is supplied to the second operation chamber and the control hydraulic pressure of the first operation chamber is released through the first control port.

* * * * *